US007121900B2

(12) United States Patent
Thomas et al.

(10) Patent No.: US 7,121,900 B2
(45) Date of Patent: Oct. 17, 2006

(54) OUTGASSING SHIELD FOR LAMP SOCKET

(75) Inventors: Ronald E. Thomas, Warren, PA (US); Timothy J. Miller, Warren, PA (US)

(73) Assignee: OSRAM Sylvania Inc., Danvers, MA (US)

( * ) Notice: Subject to any disclaimer, the term of this patent is extended or adjusted under 35 U.S.C. 154(b) by 0 days.

(21) Appl. No.: 10/920,517

(22) Filed: Aug. 18, 2004

(65) Prior Publication Data

US 2006/0040566 A1 Feb. 23, 2006

(51) Int. Cl.
*H01R 24/00* (2006.01)

(52) U.S. Cl. ..... 439/699.2

(58) Field of Classification Search ..... 439/699.2, 439/607, 485

See application file for complete search history.

(56) References Cited

U.S. PATENT DOCUMENTS 2,232,816 A * 2/1941 Van Horn ..... 313/42
5,411,407 A * 5/1995 Thomas ..... 439/271
5,600,909 A * 2/1997 Hooper ..... 40/558
5,838,104 A * 11/1998 Rutan et al. ..... 313/560
5,971,814 A * 10/1999 Boyd et al. ..... 439/699.2

OTHER PUBLICATIONS

Derwent Publication No. Au2003101016A2, Mar. 25, 2004. Spotlight device structure with transparent compact glass shield.*

* cited by examiner

*Primary Examiner*—Javaid H. Nasri
(74) *Attorney, Agent, or Firm*—William H. McNeill

(57) ABSTRACT

An outgassing shield (40) for a lamp socket (22) comprises a cup-shaped unit that fits over the end of the socket that penetrates a lamp reflector (12), reducing the temperature upon the socket body and substantially eliminating outgassing. The elimination of the outgassing prevents deleterious buildup of outgassed materials on the reflector surface and the interior of the lens, thereby enhancing light output.

2 Claims, 2 Drawing Sheets

OUTGASSING SHIELD FOR LAMP SOCKET

TECHNICAL FIELD

This invention relates to lamp sockets and more particularly to lamp sockets for an automotive application. Still more particularly, it relates to a lamp socket having a reduced tendency to outgas products that can deposit on the reflector and lens of a lamp body thereby reducing the efficiency of the lamp.

BACKGROUND ART

While applicable to any lamp socket constructed of a material having a tendency to outgass material that can be adversely deposited upon a viewing surface, this invention is particularly applicable to automotive sockets employed in taillights and turn signal lights. Such sockets are shown, for example, in U.S. Pat. Nos. 5,411,407 and 5,971,814, both assigned to the assignee of the present invention.

Such sockets can be constructed of nylon with a 43% glass fill and are usually designated as S8 sockets that take S8 bulbs. The S8 bulb has a wedge base that frictionally engages contacts within the socket and these bulbs can operate at temperatures above 100° C. At such temperatures entrained gases can be out-gassed from the socket material and deposit upon the lamp envelope adversely affecting the lamp's performance.

DISCLOSURE OF INVENTION

It is, therefore, an object of the invention to obviate the disadvantages of the prior art.

It is another object of the invention to enhance lamp sockets

These objects are accomplished, in one aspect of the invention, by the provision, in a lamp socket formed from gas-containing material, of an out-gassing shield covering at least part of said socket.

In a preferred embodiment of the invention the socket has a socket body extending from a base, with the socket body being adapted to be inserted into a lamp body and the out-gassing shield being positioned on a part of the socket body that is positioned within the lamp body.

The shield maintains a lower temperature upon the socket and prevents or severely limits the amount of outgassing that can occur.

BEST MODE FOR CARRYING OUT THE INVENTION

For a better understanding of the present invention, together with other and further objects, advantages and capabilities thereof reference is made to the following disclosure and appended claims taken in conjunction with the above-described drawings.

Figure 1:
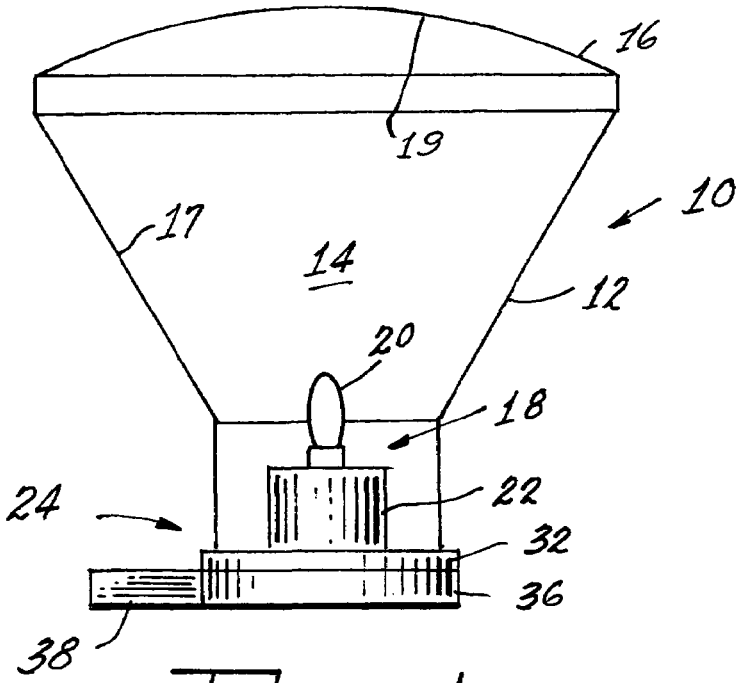
FIG. 1 is a diagrammatic elevational sectional view of a lamp employing the invention.
Figure 2:
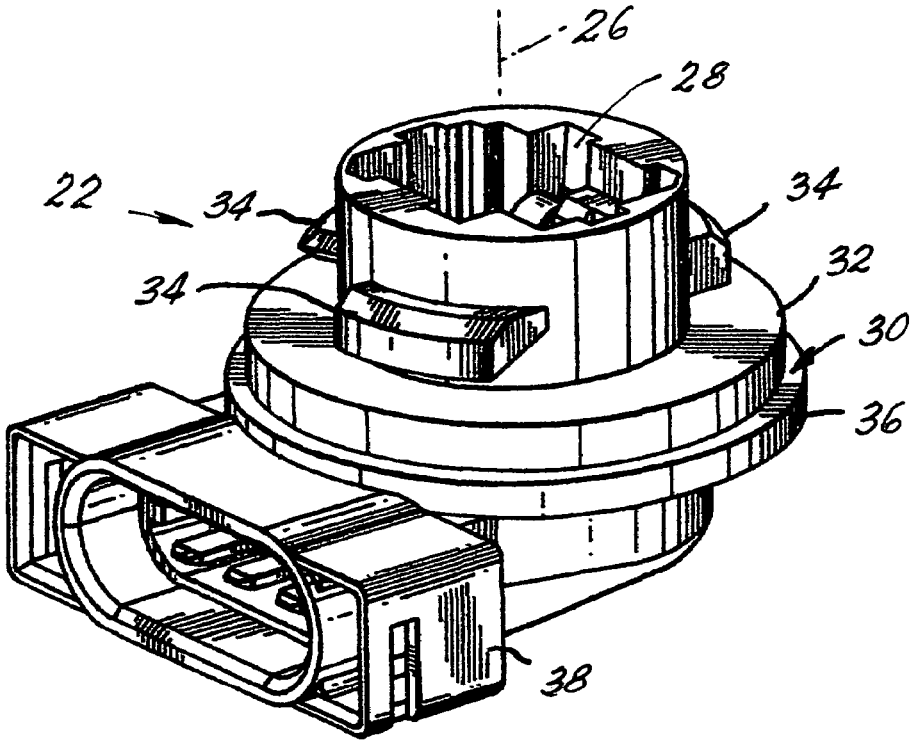
FIG. 2 is a perspective view of a lamp socket with which the invention can be used'

Referring now to the drawings with greater particularity, there is shown in FIG. 1 a lamp 10 having a body 12 comprised of a cavity 14 and a lens 16. The inner surface 17 of the cavity 14 has a reflective finish thereon. A lamp unit 18 comprising a lamp 20 mounted in a socket body 22 is fitted into the base 24 of the lamp body, as is conventional.

The socket body 22 is disposed about a longitudinal axis 26. The socket body is composed of a material, such as nylon with a 43% glass filling, that is subject to outgassing with elevated temperatures. While the use of higher temperature materials to prevent outgassing would be an option, it is not really a solution since the higher cost would be a negative factor.

The body 22 has an opening 28 containing a plurality of electrical contacts and a reception area for the bulb 20.

The body 22 further has a gasket reception area 30 surrounding the body 22 for receiving a gasket 32. Typically, the gasket 32 will be a pre-molded Santoprene gasket, which will stretch to fit over the conventional lamp socket threads 34 such that the gasket will bear against the reflector base 24 when the lamp socket is positioned for use. The gasket reception area 30 has an overhang 36 to aid in the installation of the lamp socket in the reflector. A shroud 38 projects from the socket body 22 and contains the electrical terminals for connection to a power source.

Figure 3:
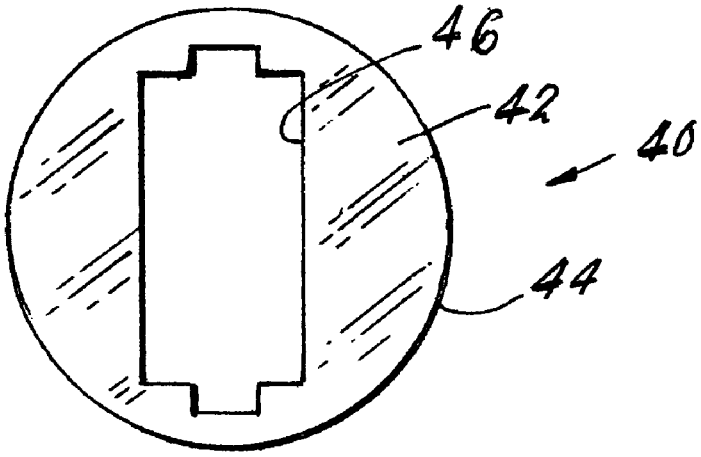
FIG. 3 is a plan view of the outgassing shield of the invention.
Figure 4:
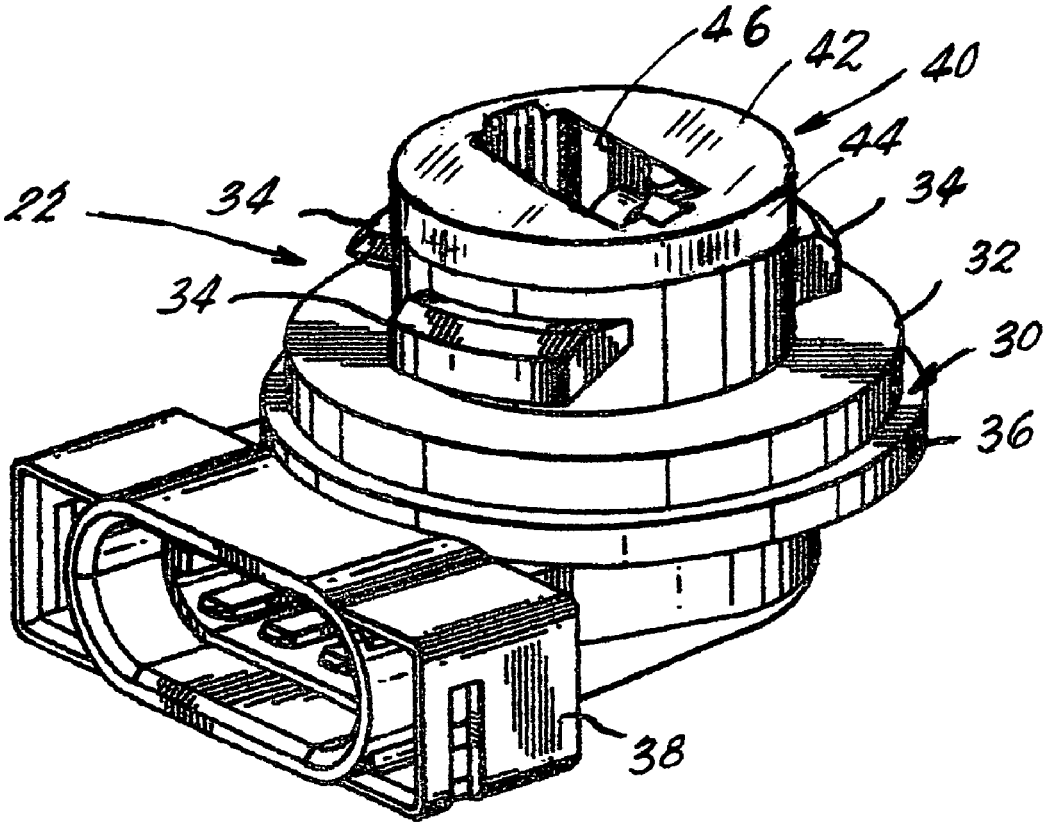
FIG. 4 is perspective view of a lamp socket with the outgassing shield in place.

Referring now to FIG. 3 there is shown an outgassing shield 40 that is substantially cup-shaped with a surface 42 and a circumferential sidewall 44. An opening 46 is provided in the surface 42 to allow insertion of the bulb 20. The shield 40 covers substantially all of the plastic components of the socket body that project within the lamp body 12 and creates a lower temperature zone when the lamp 20 is operating, thereby reducing the amount of outgassing and the consequent deposition of undesirable quantities of material upon the reflector surface 17 and the interior of the lens 19. Preferably, the surface 42 substantially matches the reflectance characteristics of the reflector surface 17. With the shield installed the socket body is not apparent to a viewer when the lamp is not operating, thus contributing to the aesthetic appeal of the lamp. Further, it is possible under certain conditions that the light output of the lamp can be increased.

The shield 40 is fitted over the interior portion of the socket body 22 and can be held in place frictionally or by other means, such as glue or pins.

While numerous materials are suitable for the shield 40, a preferred material is 430 stainless steel having a thickness of 0.4 mm.

Tests run on sockets with and without the shield show a 23° C. reduction in upper body temperature with the shield in place, thus effectively inhibiting outgassing and the subsequent unwanted deposition of extraneous material on the reflector and lens of the lamp assembly.

While there have been shown and described what are present considered to be the preferred embodiments of the invention, it will be apparent to those skilled in the art that various changes and modifications can be made herein without departing from the scope of the invention as defined by the appended claims.

What is claimed is:

1. In a lamp socket formed from gas-containing material the improvement comprising;

an out-gassing shield covering at least part of said socket, said socket having a socket body extending from a base, and being adapted to be inserted into a lamp body; said out-gassing shield being positioned on a part of said socket body that is positioned within said lamp body, said gas-containing material being a plastic material and said out-gassing shield being metal;

said lamp body including a reflector portion and a lens portion, said reflector portion having a reflector surface and said out-gassing shield having a reflector surface substantially matching said lamp body reflector surface.

2. The lamp socket of claim 1 wherein said out-gassing shield is constructed from stainless steel.

* * * * *